US006481402B1

(12) United States Patent
Simpson et al.

(10) Patent No.: US 6,481,402 B1
(45) Date of Patent: Nov. 19, 2002

(54) VARIABLE CAMSHAFT TIMING SYSTEM WITH PIN-STYLE LOCK BETWEEN RELATIVELY OSCILLATABLE COMPONENTS

(75) Inventors: Roger T. Simpson, Ithaca, NY (US); Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 09/903,363

(22) Filed: Jul. 11, 2001

(51) Int. Cl.[7] ..... F01L 1/34

(52) U.S. Cl. ..... 123/90.17; 123/90.12; 74/568 R

(58) Field of Search ..... 123/90.17, 90.15, 123/90.12

(56) References Cited

U.S. PATENT DOCUMENTS 4,858,572 A * 8/1989 Shirai et al. ..... 123/90.12
5,797,361 A * 8/1998 Mikame et al. ..... 123/90.17
6,053,138 A 4/2000 Trzmiel et al.
6,250,265 B1 * 6/2001 Simpson ..... 123/90.17
6,311,655 B1 * 10/2001 Simson et al. ..... 123/90.17

* cited by examiner

*Primary Examiner*—John J. Vrablik
*Assistant Examiner*—Jaime Corrigan
(74) *Attorney, Agent, or Firm*—Greg Dziegielewski; Thomas A. Meehan; Emch, Schaffer, Schaub & Porcello Co., L.P.A.

(57) ABSTRACT

A variable camshaft timing phaser (10; 110; 210) in which a rotor (12; 112;212) that is secured to a rotatable camshaft is selectively advanced or retarded in position relative to a surrounding rotatable housing (14; 114, 214), the rotor having at least one outwardly extending vane (20; 120; 220) that is received in an inwardly facing recess (18; 118; 218). Pressurized oil is selectively delivered to one of an advance portion or a retard portion of the recess, and simultaneously withdrawn from the other of the advance portion and the retard portion, by adjusting the axial position of an axially shiftable spool valve (22; 122; 222). The spool valve has a null position, and the relative positions of the rotor and the housing are positively locked in position when the spool valve is in its null position by a locking pin (48; 148; 248). The locking pin is resiliently biased towards a locking position by a spring (52; 152; 252), and is urged away from its locking position by pressurized oil from a source.

2 Claims, 3 Drawing Sheets

VARIABLE CAMSHAFT TIMING SYSTEM WITH PIN-STYLE LOCK BETWEEN RELATIVELY OSCILLATABLE COMPONENTS

CROSS REFERENCE TO RELATED APPLICATIONS

Not Applicable.

REFERENCE TO MICROFICHE APPENDIX

Not Applicable.

FIELD OF THE INVENTION

This invention relates to an hydraulic variable camshaft timing ("VCT") system for an internal combustion engine. More particularly, this invention relates to a system of the foregoing character with a moveable locking pin to lock the relative positions of a rotor attached to a rotating camshaft and a surrounding rotatable housing, which is otherwise relatively oscillatable with respect to the camshaft, during periods of low engine oil pressure and when an engine control system is operating to prevent relative oscillation between the camshaft and the surrounding housing.

BACKGROUND OF THE INVENTION AND DESCRIPTION OF THE RELATED ART INCLUDING INFORMATION DISCLOSED UNDER 37 CFR §1.97, 1.98

Commonly assigned U.S. Pat. No. 6,250,625 describes an hydraulic VCT system of the self-powered type, that is, a type in which relative oscillating movement between a rotor secured to a rotating camshaft and a rotatable housing that surrounds the camshaft rotor is actuated by torque pulsations in the camshaft as the camshaft alternatingly opens and closes engine intake or outtake valves. The disclosure of the aforesaid U.S. Pat. No. 6,250,625 is incorporated by reference herein.

As is disclosed in the foregoing reference, it is desirable to prevent relative oscillation between the camshaft rotor and surrounding housing during periods of low engine oil pressure. To that end, the aforesaid reference teaches the use of an annular locking plate that rotates with the camshaft and is axially moveable relative to the camshaft and the surrounding housing to move into or out of engagement with the housing. Such movement serves to prevent relative oscillating movement between the housing and the camshaft when the locking plate is in engagement with the housing. The locking plate is biased away from locking engagement by engine oil pressure that acts on a surface thereof, and is spring biased into engagement during periods of normal operations by the biasing force of a spring acting on an opposed surface of the locking plate, the oil pressure being sufficient to overcome the biasing force of the spring to keep the locking plate out of its locking position during such periods of normal operation; however, during engine start-up or other periods of low engine oil pressure, the force of the biasing spring will overcome the opposed force of the engine oil, and will move the locking plate into its locking position.

Commonly assigned, co-pending U.S. patent application Ser. No. 09/488,903, now U.S. Pat. No. 6,311,655 B1, the disclosure of which is also incorporated by reference herein, also discloses an hydraulic VCT system with an arrangement to prevent relative oscillation between a rotating camshaft, specifically, a vane-carrying rotor that is secured to the camshaft, and a rotating housing that surrounds the camshaft rotor during periods of low engine oil pressure. The VCT system of the '903 application is a system that relies on engine oil pressure for its actuation, rather than camshaft torque pulsations, to cause relative oscillation between the camshaft and the housing, and it relies on a slidable locking piston carried by a lobed rotor attached to the camshaft to slide a locking pin into a position in engagement with the housing during periods of low engine oil pressure.

Other patents that disclose various other hydraulic VCT arrangements for preventing relative oscillation between a camshaft and a surrounding housing during periods of low engine oil pressure include U.S. Pat. Nos. 6,053,138 (Trzmiel et al.), 4,858,572 (Shirai et al.) and U.S. Pat. No. 5,797,361 (MiKame et al.).

BRIEF DESCRIPTION OF INVENTION

The present invention relates to a VCT system, either of the cam torque actuated ("CTA") type or the engine oil pressure actuated ("OPA") type, in which the positions of the relatively oscillating camshaft rotor and a surrounding housing can be locked when desired, even during normal operating conditions when engine oil pressure is relatively high. The camshaft rotor carries a slidable pin, which is slidable into and out of locking position with respect to the housing, and the sliding action of the slidable pin is controlled, not strictly as a function of engine oil pressure, but by the position of a control spool valve that is slidable along its axis to selectively control flow into and out of advance and retard chambers of the housing.

The control spool valve of the present invention has a centered or null position in which flow into and out of the advance and retard chambers is blocked. At the null position of the spool valve, however, a separate passage that contains the locking pin, which is spring biased towards its locking position and is subject to an opposing hydraulic force to urge it to its unlock position, is depressurized, which results in the locking of the rotor and the housing elements relative to one another. When the spool valve is on one side or another of its null position, the locking pin passage is pressurized to move the pin to its unlock position, at least during periods of adequate engine oil pressure, and oil will flow into one of the advance and retard chambers, and out of the other, to thereby lead to a phase change between the camshaft rotor and the surrounding housing. Thus, the rotor and housing are always positively locked in position relative to one another when there is no need to change the phase therebetween, which is the condition in which the engine control system controls the spool valve to maintain it at its null position. The locking of the positions of the rotor and housing relative to one another can occur at any of many potentially relative positions therebetween, depending on when the control system operates to reposition the spool valve to its null position.

Accordingly, it is an object of the present invention to provide an improved hydraulic VCT system. More particularly, it is an object of the present invention to provide a VCT system in which the relative positions of a camshaft rotor and a surrounding housing are positively locked when the control system is operating to control such elements without relative oscillating motion therebetween.

For a further understanding of the present invention and the objects thereof, attention is directed to the drawing and the following brief description thereof, to the detailed description of the preferred embodiment and to the appended claims.

BRIEF DESCRIPTIONS OF THE DRAWINGS

DETAILED DESCRIPTION OF THE INVENTION

Figure 1:
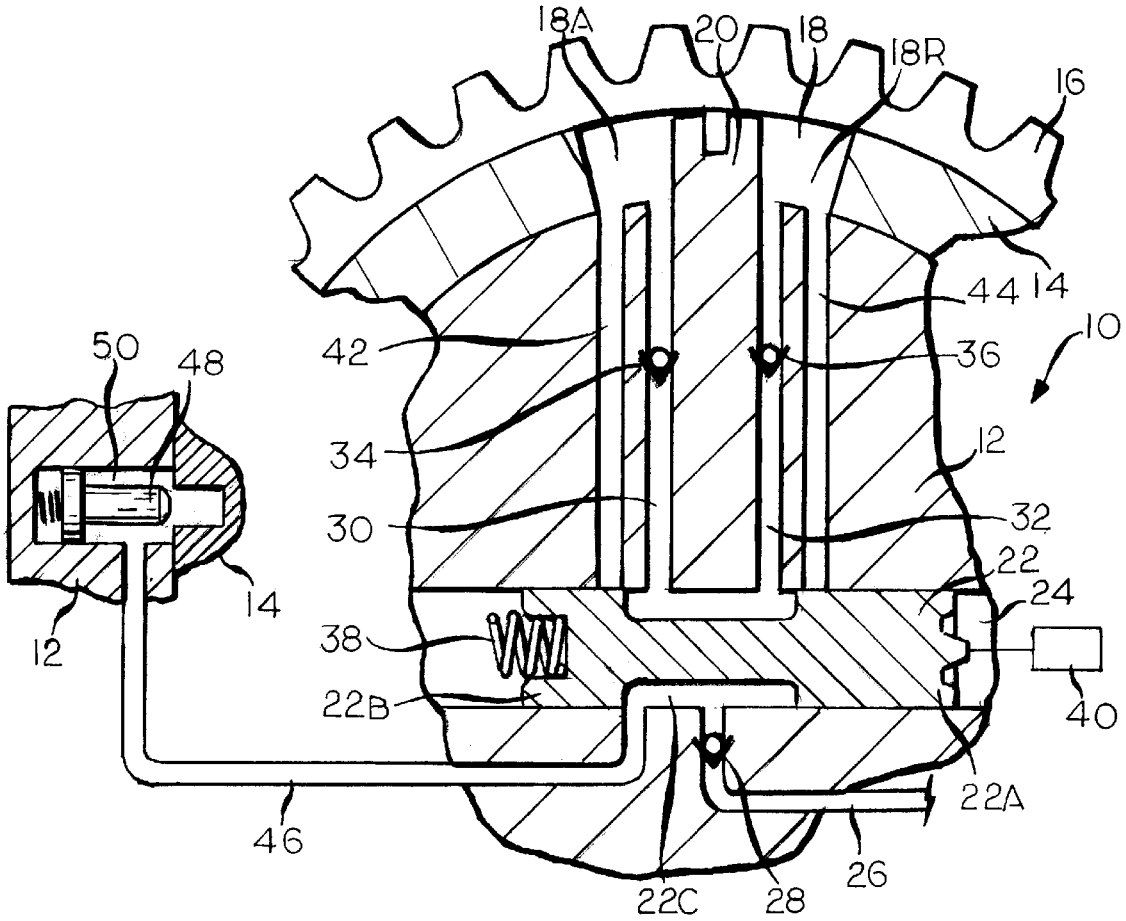
FIG. 1 is a fragmentary schematic of an hydraulic VCT system according to the present invention in a certain operating condition of the elements thereof.

A camshaft phaser according to the present invention is generally identified by reference number 10 in FIG. 1. The camshaft phaser has a rotor 12 that is secured to a rotatable camshaft, otherwise not shown, and a housing 14 that surrounds the rotor 12, the housing 14 being rotatable with the rotor 12 and having teeth 16 on its outer periphery to permit it to be driven by a belt or chain from a crankshaft or another camshaft, as is known in the art. The housing 14 has a multitude of inwardly facing recesses 18, and the rotor 12 carries a multitude of outwardly extending vanes 20, each of which extends into a recess 18. The circumferential extent of each recess 18 is greater than that of the vane that extends thereinto, to permit limited oscillating motion of the rotor 12 and the housing 14 with respect to one another. In that regard, each recess has an advance portion 18A and a retard portion 18R, which are sealingly separated from one another by the vane 20 that extends into such recess 18, and the addition of pressurized oil into the advance portion 18A of the recess 18, with the simultaneous withdrawal of pressurized oil from the retard portion 18R of the recess 18, in a manner that will be hereinafter described in greater detail, will cause the rotor 12 to advance in position relative to the housing 14. Likewise, the addition of pressurized oil into the retard portion 18R of the recess 18, with the simultaneous withdrawal of pressurized oil from the advance portion 18A of the recess 18, will cause the rotor 12 to retard in its position relative to the housing 14.

The camshaft phaser 10 further has a spool valve with a spool 22 that is axially shiftable within a passage 24 within the rotating camshaft. The spool 22 has a spaced apart pair of lands 22A, 22B that slide snuggly within the passage 24, and a reduced diameter central portion 22C between the lands 22A and 22B. Pressurized engine oil is delivered from the engine (not shown) to the passage 24 from an inlet line 26, which discharges the oil into the passage in alignment with the central portion 22C of the spool 22 in the position of the spool 22 that is shown in FIG. 1, the inlet line 26 being provided with a one-way flow check valve 28 to prevent reverse flow from the passage 24 through the inlet line 26. Depending on the axial position of the spool 22, oil from the inlet line can flow from the central portion 22C into the advance portion 18A of the recess 18 through an inlet line 30, or into the retard portion 18R of the recess 18 through an inlet line 32, inlet lines 30, 32 being provided with one-way flow, check valves 34, 36, respectively, to prevent reverse flow from the advance portion 18A and the retard portion 18R to the inlet line 26 through the inlet lines 30 or 32.

Figure 2:
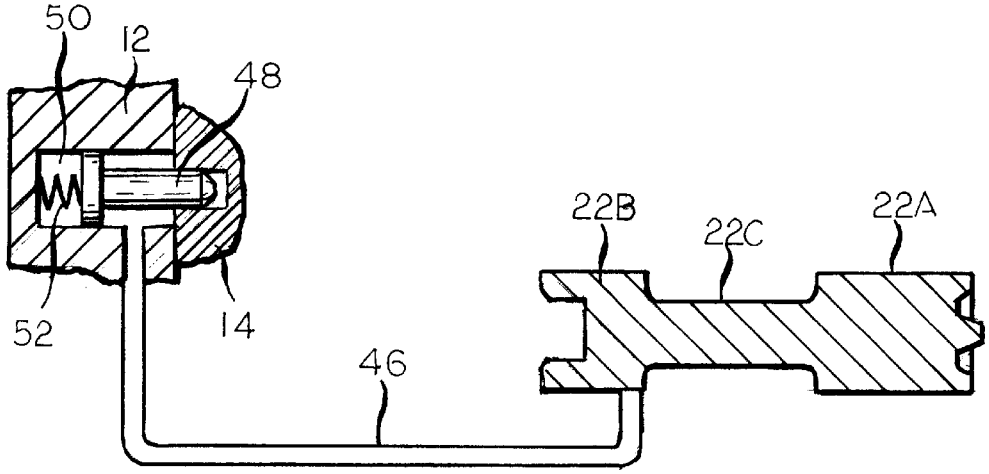
FIG. 2 is a partial fragmentary schematic of the VCT system according to FIG. 1 in a different operating condition of the elements thereof.

The spool 22 is resiliently urged to the right, as shown in FIG. 2 by a spring 38 that acts on an end of the spool 22, and is urged to the left by a variable force solenoid, shown schematically as element 40, that acts on the opposed end of spool 22. In the FIG. 1, null position of the spool 22, there will be no flow into or out of either the advance portion 18A or the retard portion 18R because return lines 42, 44 from the advance portion 18A, and the retard portion 18R, respectively, are blocked by the lands 22B, 22A of the spool 22, respectively. During this time, oil pressure from the central portion 22*c* of the spool 22 is imposed through an inlet line 46 on a locking pin 48 in a radially extending passage 50 within the rotor 32 to maintain the locking pin 48 out of locking engagement with the housing 14, notwithstanding that the pin is resiliently biased into such locking engagement by a spring 52 (FIG. 2). When the spool 22 is moved either to the right (FIG. 2) of its null position (FIG. 1) or to the left thereof (not shown) by a variation in force imposed on the spool 22 by the solenoid 40, the inlet line 46 will be blocked either by land 22B or land 22A, as the case may be, and the rotor will then be locked in an advance position (not shown) relative to the housing 14 (not shown) or a retard position (FIG. 1) until a control system (not shown) that controls the position of the solenoid 40 acts to return the spool 22 to its null position. Of course, the spring 52 will also act to lock the position of the rotor 12 relative to the housing 14 during periods of low engine oil pressure, even when the spool 22 is in its null position, because the force of the oil pressure on the locking pin 48 will be insufficient to overcome the opposed force imposed on the spool 22 by the spring 52. It is also contemplated that controlled leakage from the passage 50 may be desirable to prevent the locking pin 48 from moving too rapidly from its unlocked position to its locking position, and to that end an oil outlet line (not shown) with a suitably sized orifice may be provided to permit some slow escape of oil from the passage 50 to the engine sump (not shown).

Figure 3:
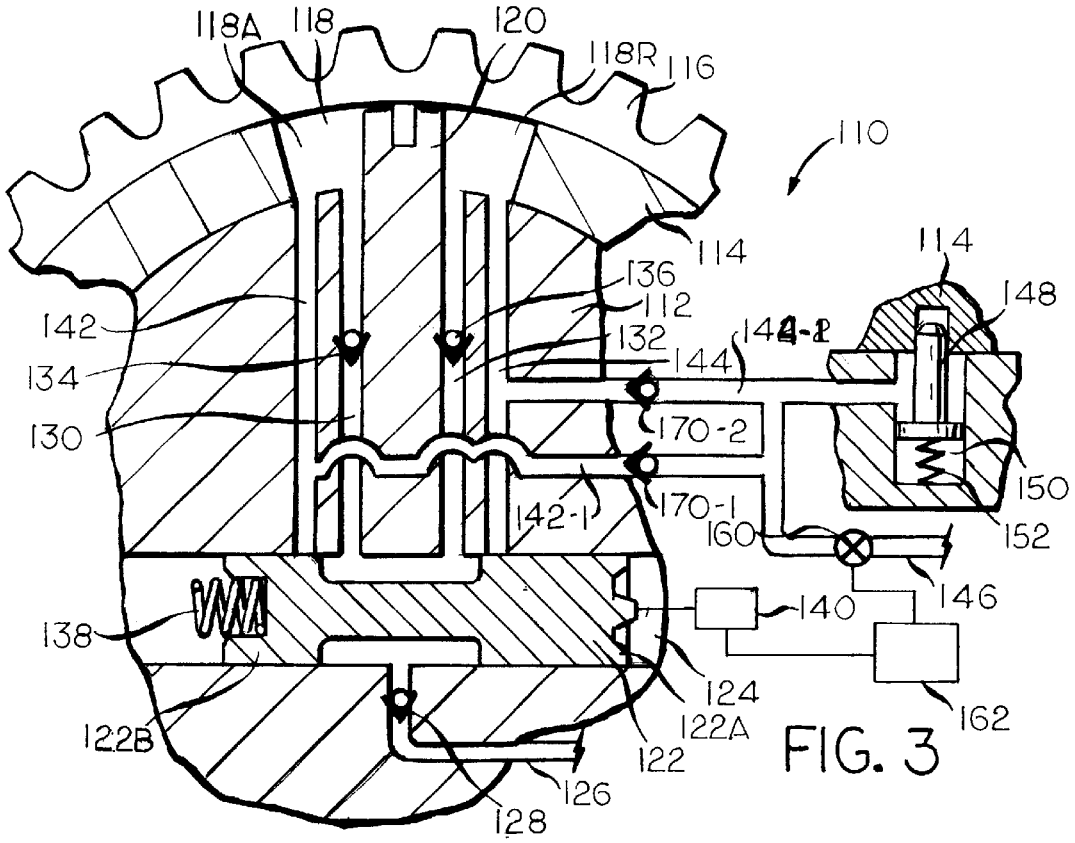
FIG. 3 is a view like FIG. 1 of a different hydraulic VCT system according to the present invention in a certain operating condition of the elements thereof.
Figure 4:
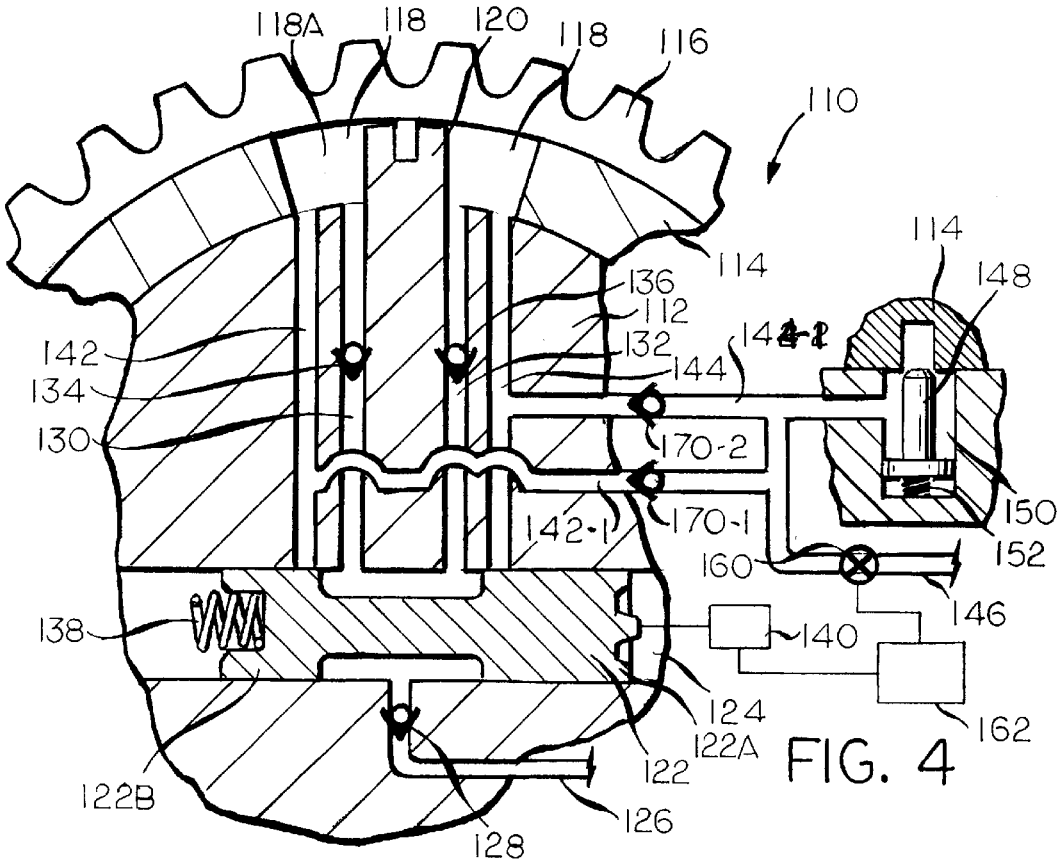
FIG. 4 is a partial fragmentary schematic view of the VCT system of FIG. 3 in a different operating condition of the elements thereof.

A camshaft torque pulse phaser according to an alternative embodiment of the present invention is generally identified by reference number 110 in FIGS. 3, 4; in that regard, each element of FIGS. 3, 4 that corresponds to an element of the embodiment of FIGS. 1, 2 is indicated by a 100 series reference numeral, the last two digits of which are the two digits of the corresponding embodiment of FIGS. 1, 2. In any case, the phaser 110 has a rotor 112 that is secured to a rotatable camshaft, otherwise not shown, and a housing 114 that surrounds the rotor 112 and it rotatable therewith, the housing 114 having teeth 116 on its outer periphery to permit it to be driven by a belt or chain from a crankshaft or another camshaft, as is known in the art. The housing 114 has a multitude of inwardly facing recesses 118, and the rotor 112 carries a multitude of outwardly extending vanes 120 each of which extends into a recess 118. The circumferential extent of each recess 118 is greater than that of the vane 120 that extends thereinto, to permit limited oscillation of the rotor 112 and the housing 114 with respect to one another. In that regard, each recess 118 has an advance portion 118A and a retard portion 118R on opposite sides of the vane 120, and the addition of pressurized oil into the advance portion1 18A of the recess 118, with the simultaneous withdrawal of pressurized oil from the retard portion of 118R of the recess 118, in a manner that will be described in greater detail, will cause the rotor 112 to advance in position relative to the housing 114. Likewise, the addition of pressurized oil into the retard portion1 18R of the recess 118, and the simultaneous withdrawal of pressurized oil from the advance portion 118A of the recess 118, will cause the rotor 112 to retard in its position relative to the housing 114.

The phaser 110 has a spool valve with a spool 122 that is axially shiftable within a passage 124 within the rotating camshaft. The spool 122 has a spaced apart pair of lands 122A, 122B that slide snugly within the passage 124, and a reduced diameter central portion 122C between the lands 122A, 122B. Pressurized engine oil is delivered to the passage 124 from an inlet line 126, which discharges the oil into the passage 124 in alignment with the central portion 122C of the spool 122 in the position of the spool 122 that is shown in FIG. 3, the inlet line 126 being provided with a one-way flow, check valve 128 to prevent reverse flow from the passage 124 through the inlet line 126. Depending on the axial position of the spool 122, oil from the inlet line 126 can flow from the reduced diameter portion 122C of the spool 122 into the advance portion 118A of the recess 118 through an inlet line 130, or into the retard position 118R of the recess 118 through an inlet line 132, the lines 130, 132 being provided with one-way flow, check valves 134,136, respectively, to prevent reverse flow from the advance portion 118A and the retard portion A 118R of the recess 118 to the inlet line 126 through the inlet lines 130, 132.

The spool 122 is resiliently urged to the right, as shown in FIG. 3, by a spring 138 that acts on an end of the spool 122, and is urged to the left by a variable force solenoid, shown schematically as element 140, that acts on the opposed end of the spool 122. In the FIG. 3, null position of the spool 122, there will be no flow into or out of either the advanced portion 118A or the retard portion 118R of the recess 118 because return lines 142, 144 from the advance portion 118A and the retard portion 118R, respectively, are blocked by the lands 122B, 122A of the spool 122, respectively. During this time, oil pressure from the portion 122C of the spool 122 is imposed through an inlet line 146 on a locking pin 148 in a radially extending passage 150 within the rotor 112, to maintain the locking pin 148 out of locking engagement with the housing 114, notwithstanding that it is resiliently biased into such locking engagement by a spring 152 (FIG. 3).

When the spool 122 is moved either to the right (FIG. 4) of its null position (FIG. 3) or to the left thereof (not shown) by a variation in force imposed on the spool 122 by the solenoid 140, pressurized oil in the inlet line 146, which is selectively opened or closed to flow by a valve 160, will put pressure on the locking pin 148 to drive it out of locking engagement with the housing 114, against the biasing force of the spring 152. The valve 160 is selectively opened or dosed under a command from an electronic control 162, which also controls the force level on the solenoid 140. Of course, during periods of low engine oil pressure, even when the valve 160 is opened to permit oil to flow through the line 146 to impose a force on the locking pin 148, such force will be insufficient to overcome the opposed force on the locking pin 148 that is imposed by the spring 152. Thus, the relative positions of the rotor 112 and the housing 114 are locked on command by the signal imposed on the valve 160 by the electronic control unit 162, so that no advance or retard movement of the rotor 112 will occur at times when such advance or retard movement is not desired.

Figure 5:
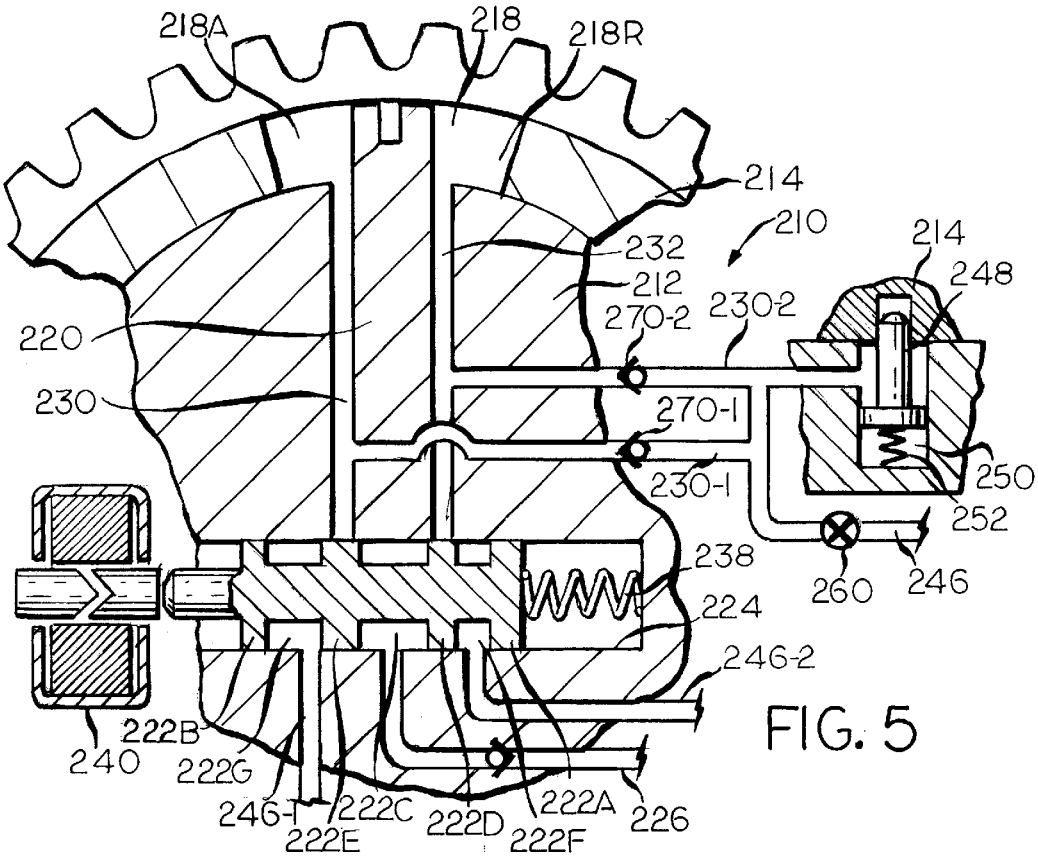
FIG. 5 is a partial, fragmentary schematic view like FIG. 1 and FIG. 3 of yet another hydraulic VCT system according to the present invention in a certain operating condition of the elements thereof.
Figure 6:
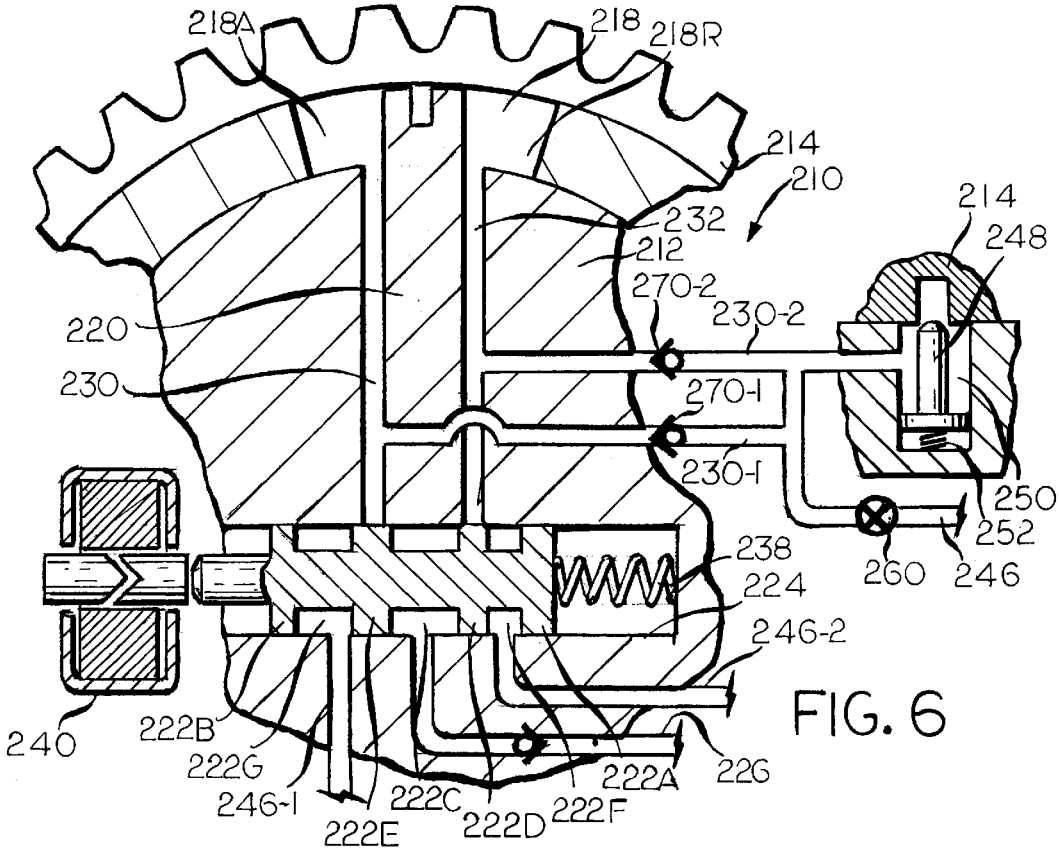
FIG. 6 is a partial fragmentary schematic view of the VCT system of FIG. 5 in a different operating condition in the elements thereof.

In the embodiment of FIGS. 5, 6, elements are identified by the 200 series reference numerals, the last two digits of which are the two digits of the corresponding element of the embodiment of FIGS. 1, 2, or the last two digits of the corresponding element of the embodiment of FIGS. 3, 4, as the case may be.

The camshaft phaser illustrated in FIGS. 5,6 is generally identified by reference numeral 210, and the phaser 210 has a rotor 212 that is secured to a rotatable camshaft, otherwise not shown, and a housing 214 that surrounds the rotor 212 and is rotatable therewith, the housing 214 having teeth 216 on its outer periphery to permit it to be driven by a belt or chain from a crankshaft or another camshaft, as is known on the art The housing 214 has a multitude of inwardly facing recesses 218, and the rotor 212 carries a multitude of outwardly extending vanes 220 each of which extends into a recess 218. The circumferential extent of each recess 218 is greater than that of the vane 220 that extends thereinto to permit limited oscillation of the rotor 212 and the housing 214 with respect to one another. In that regard, each recess 218 has an advance portion 218A and a retard portion 218R, and the addition of pressurized oil into the advance portion 218A, with the simultaneous withdrawal of pressurized oil from the retard portion 218R, in a manner that will be hereinafter described in greater detail, will cause the rotor 212 to advance in position relative to the housing 214. Likewise, the addition of pressurized oil into the retard portion 218R, with the simultaneous withdrawal of pressurized oil from the advance portion 218A will cause the rotor 212 to retard in its position relative to the housing 214.

The phaser 210 has a spool valve with a spool 222 with four spaced apart lands, namely 222A, at one end thereof, 222B, at an opposed and thereof, and spaced apart intermediate lands 222D, 222E, which are positioned between the lands 222A 222B. This spool further has a first reduced diameter portion 222F, which is positioned between the lands 222A, 222D, a second reduced diameter portion 222G, which is positioned between the lands 222B, 222E, and a third reduced diameter portion 222C, which is positioned between the lands 222E, 222D. The spool 222 is axially slidable within a passage 224 within the rotating camshaft, with the lands 222A, 222D, 222E, 222B fitting snugly within the passage 224.

Pressurized engine oil is delivered to the passage 224 from an inlet line 226, which discharges it in alignment with the reduced diameter portion 222C of the spool 222 in the FIG. 5 position of the spool 222, which it is its null position. Such pressurized engine oil will then flow either into the advanced portion 218A of the recess 218, or the retard portion 218R, when the spool 222 moves one way or the other from its null position, through a line 230 or a line 232, as the case may be. When the spool 222 moves from its null position, to permit the rotor 212 to advance or retard which respect to the housing 214, oil will flow from one or the her of the advance portion 218A or the retard position 218R through the line 230 or the line 232, depending on whether the phaser 210 is operating in an advance mode or retard mode. When t phaser 210 is operating a retard mode, the oil from the advance portion 218A that flows through the line 230 will then enter the reduced diameter portion 222G of the spool 222, from which it will return to a sump (not shown) through a first return line 246-1. Likewise, when the phaser 210 is operating in an advance mode, the oil tom the retard portion 218R that flows through the line 232 will then enter the reduced diameter portion 222F of the spool 222, from which it will return to a sump pump through a second return line 246-2.

The spool 222 is resiliently biased to the left, in the orientation shown in FIG. 5, by a spring 238 that acts against an end thereof. A variable force solenoid 240 acts against an opposed end of the spool 222. At the null or FIG. 1 position of the spool 222, the solenoid will be operating at 50% of its maximum duty cycle. Thus, if the solenoid 240 operates at more than 50% of its duty cycle, the spool will move to the right, oil will flow into the retard portion 218R of the recess 218 and out of the advance portion 218A, and the rotor will retard in its position relative to the housing 214. Conversely, if the solenoid 240 operates at less than 50% of its duty cycle, the spool 222 will move to the left, and oil will flow into the advance portion 218A of the recess 218 and out of the retard portion 218R, and the rotor 212 will advance in its position relative to the housing 214.

A locking pin 248 is slidably positioned in a passage 250 in the rotor 212, and the locking pin 248 is normally pressurized by engine oil pressure from an inlet line 246, against an opposing force imposed by a spring 252, to its unlock position. The oil pressure on the locking pin 248 is controlled by a shut off valve 260 that is controlled by an electronic control unit (not shown), which may be the electronic control unit that controls the operation of the solenoid 240, to positively lock the positions of the rotor 212 and the housing 214 relative to one another in the null or FIG. 5 position of the-spool 222, when it is not desired to either advance or retard the positions of the rotor 212 and the housing 214 relative to one another. Movement of the locking pin 248 between its locked and unlocking conditions is slowed by bleeding oil from the advance portion 218A of the recess 218 into the passage 250 through a branch line 230-1, or by bleeding oil from the retard portion 218R through a branch line 230-2. The branch lines 230-1, 230-2 are provided with one ay flow control valves 2701, 2702 to prevent backflow of oil from the passage 250 into the lines 230, 232, respectively.

Although the best mode contemplated by the inventors for carrying out the present invention as of the filing date hereof has been shown and described herein, it will be apparent to those skilled in the art suitable modifications, variations and equivalents may be made without departing from the scope of the invention, such scope being limited solely by the terms of the following claims and the legal equivalents thereof.

We claim:

1. A variable camshaft timing phaser (10) comprising:

a rotor (12) secured to a camshaft for rotation therewith, the rotor having at least one vane (20) projecting outwardly therefrom;

a housing (14) surrounding the rotor and rotatable therewith, the housing having at least one inwardly facing recess (18), the at least one recess having a greater circumferential extent than the at least one vane to permit relative oscillating motion between the rotor and the housing, the at least one vane separating the at least one recess into an advance portion (18A) and a retard portion (18R);

an axially shiftable spool valve (22) having spaced apart lands (22A, 22B) with a reduced diameter portion (22C) between the spaced apart lands and spaced from each of the spaced apart lands;

an oil inlet line (26) for introducing oil from a supply to the reduced diameter portion of the spool valve at a null position of the spool valve; and a plurality of first oil flow lines (30, 32) for selectively permitting oil to flow from the reduced diameter portion of the spool valve to the advance portion or the retard portion of the at least one recess of the housing when a spool valve is positioned at one side or the other of its null position;

a locking pin (38) positioned within a passage (50), the locking pin being axially shiftable within the passage between a position where the locking pin locks the rotor and the housing relative to one another and an unlocking position in which the rotor and the housing are free to oscillate with respect to one another, the locking pin being exposed to engine oil pressure when the spool valve is in the null position, which tends to move the locking pin to its unlocking position, the locking pin being disconnected from engine oil pressure when the spool valve is away from its null position;

a spring (52) acting on the locking pin and tending to move the locking pin, against the force imposed by engine oil pressure, to its locked position; and a second oil inlet line (46) independent of said first plurality of oil inlet lines for imposing engine oil pressure on said locking pin to move said locking pin to its unlocking position when the spool valve is in its null position.

2. A variable camshaft timing phaser (10) according to claim 1 and further comprising:

said second inlet line (46) always connects the passage (50) and the reduced diameter portion (22C) of the spool valve (22) when the spool valve is in its null position.

* * * * *